United States Patent [19]

Jenkins

[11] Patent Number: 4,563,783

[45] Date of Patent: Jan. 14, 1986

[54] ASSIST HANDLE

[76] Inventor: James H. Jenkins, 6010 N. 26th St., Arlington, Va. 22207

[21] Appl. No.: 522,031

[22] Filed: Aug. 3, 1983

[51] Int. Cl.[4] ..... A47K 3/12
[52] U.S. Cl. ..... 4/576
[58] Field of Search ..... 4/576, 577, 604, 589

[56] References Cited

U.S. PATENT DOCUMENTS

| | | | |
|---|---|---|---|
| 1,405,222 | 1/1922 | Johnson | 4/576 |
| 3,028,604 | 4/1962 | Warner | 4/576 |
| 4,149,282 | 4/1979 | Browning | 4/577 |

FOREIGN PATENT DOCUMENTS

| | | | |
|---|---|---|---|
| 829836 | 3/1960 | United Kingdom | 4/576 |

*Primary Examiner*—Stephen Marcus
*Assistant Examiner*—Leo J. Peters

[57] ABSTRACT

An assist handle to be attached to the direction handle of a shower, or hot or cold water handle to be used to assist people out of a tub. The apparatus includes a slip resistant and resilient grommet at rear of rear plate; rear plate with opening for bolt to secure rear plate to direction handle and four openings to receive bolts to secure front plate to rear plate; handle trough to receive handle; front plate to be secured to rear plate by use of four bolts.

1 Claim, 2 Drawing Figures

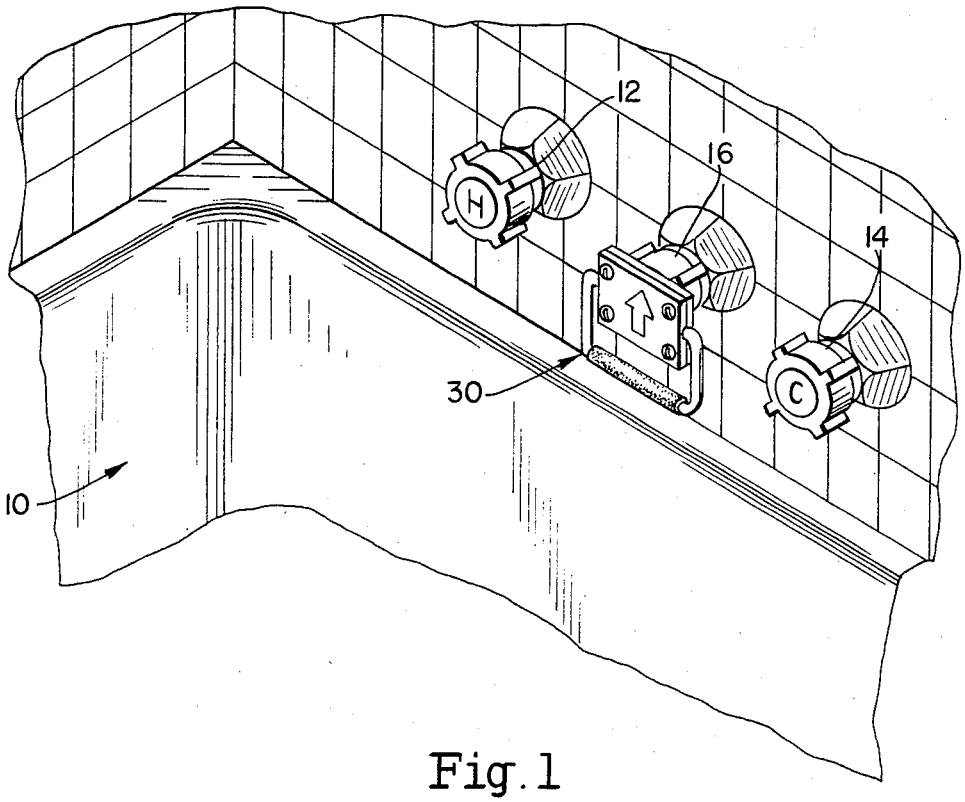
Fig. 1
Fig. 2
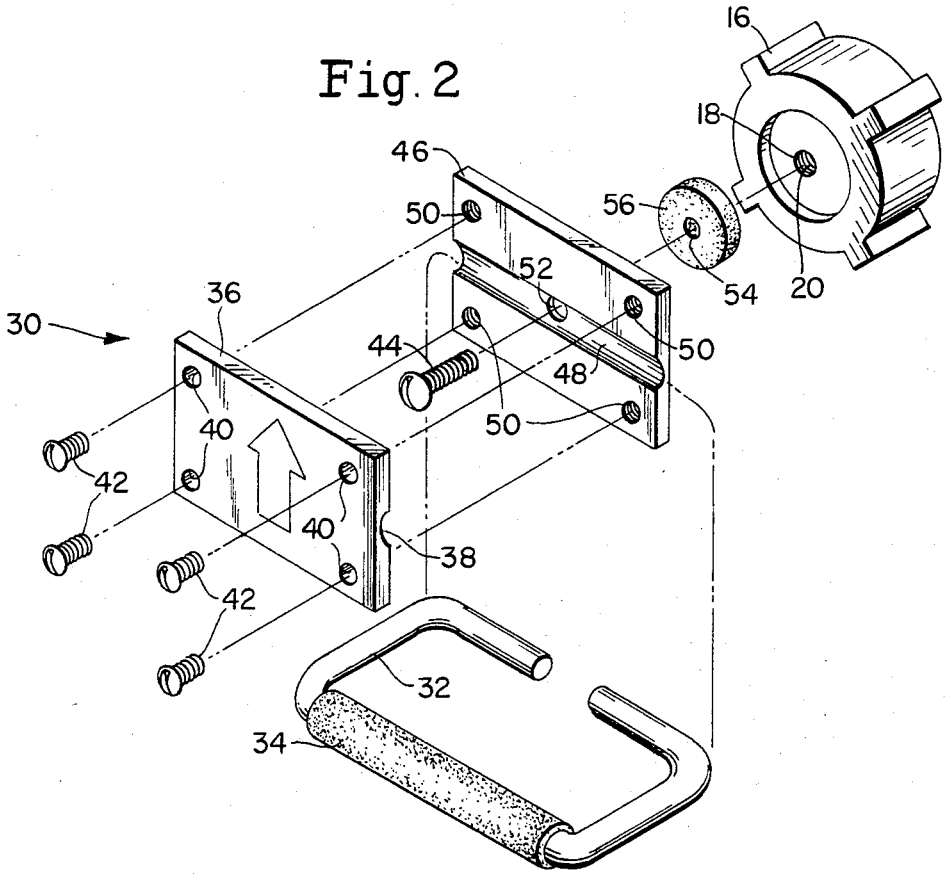

ASSIST HANDLE

BACKGROUND OF THE INVENTION

This invention is made to take the place of prior art, such as drilling holes in the tub or wall, or attaching by the use of clamps, all of which are difficult and expensive.

OBJECT OF THE INVENTION

A primary object of the present invention is to provide an improved means to assist people in and out of a tub. This invention does not require any drilling of openings in the tub or walls to attach. You simply remove the bolt holding the direction handle and attach handle apparatus to the direction handle by means of the existing bolt.

DESCRIPTION OF THE DRAWINGS

These and other objects and advantages will become apparent from a study of the following specification when viewed in the light of the accompanying drawing.

FIG. 1 is a fragmentary perspective view of the assist handle installed on the shower direction handle located in the tub area.

FIG. 2 is an exploded cross section of the assist handle viewed in its mount—the original direction handle—detailed description as shown in FIG. 1.

A typical tub assembly 10 showing a hot water knob 12 cold water knob 14 and showing shower knob 16 with assist handle 30 attached. The knob 16 is attached to a shower diverting valve as is well known per se. As shown in FIG. 2, there exists a knob 16 with screw hole 18 with threads 20 in stem behind 16, a slip resistant resilient grommet 56, rear plate 46 with opening 52 to receive bolt 44, to pass through rear plate 46 through opening 54, to thread 20 into knob 16, handle 32 to be placed in handle trough 38, covered by front plate 36, front plate 36 to be secured to rear plate 46 by means of four bolts 62, screwed into tapped threads 50 located in rear plate 46 and a, slip resistant coating 34 covers handle 32.

While in accordance with patent statutes the preferred embodiments of the invention have been illustrated and described, it will be apparent to those skilled in the art that changes may be made without deviating from the inventive concepts set forth above.

What is claimed is:

1. In a domestic tub of the type having a knob controlled diverting valve positioned between the knob controlled hot and cold water valves that lie above said tub, the improvement comprising: a safety assist grip comprised of a U-shaped handle with its ends pivotably retained between two plates by a trough in each plate with said plates held to one another by screws, and one of said plates fastened to one of said knobs by a single fastener that also serves to secure the knob to the valve controlled by the knob, whereby a user may facilitate egress from the tub by grasping the handle.

* * * * *